US005657678A

United States Patent [19]

Cohen

[11] Patent Number: 5,657,678

[45] Date of Patent: Aug. 19, 1997

[54] TONER CARTRIDGE SPLITTER

[76] Inventor: Zev B. Cohen, 5624 Oak Pl., Bethesda, Md. 20814

[21] Appl. No.: 567,123

[22] Filed: Dec. 4, 1995

[51] Int. Cl.[6] ..... B26D 3/28

[52] U.S. Cl. ..... 83/870; 225/103; 83/468.1; 83/946

[58] Field of Search ..... 83/870, 942, 633, 83/468.1, 946; 225/103

[56] References Cited

U.S. PATENT DOCUMENTS

| | | | |
|---|---|---|---|
| 576,308 | 2/1897 | Habrie | 83/870 |
| 2,685,901 | 8/1954 | Putzer | 83/870 |
| 3,580,443 | 5/1971 | Henning et al. | 225/103 |
| 4,816,877 | 3/1989 | Keen . | |
| 5,110,646 | 5/1992 | Prestel et al. . | |
| 5,223,068 | 6/1993 | Baley . | |
| 5,339,596 | 8/1994 | Cohen . | |
| 5,400,573 | 3/1995 | Crystal et al. . | |
| 5,407,518 | 4/1995 | Baley, Jr. . | |
| 5,546,830 | 8/1996 | Yuen | 225/103 |

*Primary Examiner*—Kenneth E. Peterson
*Assistant Examiner*—Sean A. Pryor
*Attorney, Agent, or Firm*—Richard C. Litman

[57] ABSTRACT

A toner cartridge splitter provides for the opening of the two major portions of a powdered toner cartridge, as used in various xerographic photocopy machines and printers. The device serves to separate the toner reservoir and mounting portions of a toner cartridge, thereby allowing the cartridge to be replenished with toner and resealed for further use, rather than merely being discarded after a single use. A toner cartridge is placed within the cartridge receptacle portion of the splitter, with the cartridge being immovably secured therein during the operation. A splitter blade is disposed coplanar with the seam of the cartridge between the two major components, and is driven between the two cartridge components to split them apart. A clearance notch may be provided in the blade to clear any protrusions in the cartridge rim which might otherwise block the penetration of the blade into the seam. The blade may be operated directly by a handle affixed thereto, or alternatively may be driven by an offset handle which provides greater mechanical advantage to a user of the device. While the present splitter is particularly adapted for use with HP Laserjet (™) printer cartridges, it is readily adaptable for use in the opening of various other cartridges of similar construction but having different external configurations.

17 Claims, 4 Drawing Sheets

TONER CARTRIDGE SPLITTER

FIELD OF THE INVENTION

The present invention relates generally to specialized cutting tools and implements, and more specifically to embodiments of a device adapted for the opening of xerographic toner cartridges which have been depleted, to provide for the replenishment of toner therein and the recycling of the cartridge for further use. The device is particularly adapted for use with toner cartridges used in the HP Laserjet (™) series of printers, but may be adapted for use with other configurations of toner cartridges as well.

BACKGROUND OF THE INVENTION

The development of the xerographic photocopying process has led to the expansion of the technology to other devices, such as printers used with computers. All devices using the xerographic printing or copying principle use a dry toner powder, which material is often supplied in a cartridge which is installed in the machine and dispensed as required during operation. Many such cartridges include various other components thereon, such as toner dispensing rollers, platens, etc., and are accordingly relatively costly to replace when the toner supply is depleted, generally after printing only some few thousand sheets of paper. However, the rollers and other hardware which are generally included with such cartridges, are often sufficiently durable to last through several refills of toner in a given cartridge. Thus, the discarding of the cartridge and accompanying hardware when the toner is depleted, is quite costly and wasteful.

The manufacturers of such cartridges are well aware of this problem, but of course desire to maximize profits by selling new toner cartridges, complete with new rollers, platens, and hardware, even though all that may be needed by the customer is a fresh supply of toner within the cartridge. In fact, in at least some cases, the manufacturer of the cartridge has included features in the cartridge which complicate the disassembly or opening of the cartridge for replenishment of the toner supply therein, in order to discourage the recycling and refilling of the cartridges at the consumer level. Many, if not most, users of such cartridges recycle their cartridges in order to reduce expenses; a recycled cartridge may cost only one half or less the price of a new cartridge. However, the used cartridges must still be sent out to another facility, or back to the manufacturer, for recycling.

Accordingly, a need will be seen for a tool which enables the user of toner cartridges to replenish and recycle such cartridges at the user or consumer level. The tool should provide for the opening of the depleted cartridges along an existing seam of the cartridge, in order to minimize damage to the cartridge, and must be relatively economical to purchase, compact, and easy to use without any significant training. By opening the cartridge along an existing seam where the seal is installed, the present cartridge splitting tool may also provide for the convenient installation of a new seal in the replenished cartridge, in order to retain the fresh supply of toner therein until installation within the printer or other device in which the cartridge is to be used.

DESCRIPTION OF THE PRIOR ART

U.S. Pat. No. 4,816,877 issued to Fred Keen on Mar. 28, 1989 describes a Refillable Toner Cartridge And Method of Manufacture Thereof, utilizing an existing conventional toner cartridge as manufactured for use in Canon (™) photocopiers. Keen is directed primarily to a method of modifying such cartridges so they may be refilled at the consumer level, and further to such cartridges as modified for refilling by the consumer. The present invention utilizes an unmodified cartridge, but provides a specialized tool providing for the opening of such cartridges. Thus, a user of the present cartridge splitting tool need not be concerned with whether or not certain specialized cartridges have been provided for refilling or not, as the present tool works with unmodified cartridges.

U.S. Pat. No. 5,110,646 issued to James D. Prestel et al. on May 5, 1992 describes a Process And Materials For Reconditioning A Toner Cartridge, wherein the magnetic roller is removed from the cartridge and the opening thereunder to the toner chamber is resealed with a new seal. The roller is replaced, and the cartridge refilled using the original filler plug. While this system may be acceptable for some types of cartridges in which the filler cap is easily accessible, in many types of cartridges (e.g., the HP Laserjet—™—cartridge) the filler plug is not easily accessible due to other structure which is disposed thereover. The present cartridge splitter provides for the replenishment of toner within such cartridges, without need to access the filler plug of the cartridge.

U.S. Pat. No. 5,223,068 issued to Raymond Baley on Jun. 29, 1993 describes a Reconditioned And Resealed Toner Cartridge, the Method Of Making The Same, And A Table Saw Used In This Method. The patent describes a table saw having a horizontal blade which is used to cut the seam between the toner hopper and mounting and roller structure of the toner cartridge, providing a new seal therebetween, and resealing the two components of the toner cartridge. Baley is silent on the specific means used to refill the cartridge with toner; however, he states that the cartridge is refilled after the two portions of the cartridge are reassembled together. This is a difficult undertaking with some types of cartridges, as noted further above. Moreover, the Baley motorized table saw method requires the cartridge to be reversed in a movable holding cart which is twice passed along the single saw blade, so the blade may pass along each side of the cartridge seam. The present manual splitter tool opens the cartridge in a single pass.

U.S. Pat. No. 5,339,596 issued to Zev B. Cohen on Aug. 23, 1994 describes a Toner Cartridge Recharging Tool, comprising a base and cartridge holder which aligns one end of the cartridge with a thin, elongated tongue. The tongue is wrapped with a fresh seal and inserted into one end of the cartridge, without any splitting or disassembly of the cartridge. The cartridge is then refilled with toner using the existing filler plug, by cutting the overlying structure of the cartridge as may be required. The present splitter obviates any need for the seal insertion tool, as the cartridge is opened along the seal seam for refilling with toner. Thus, a new seal may be applied to the toner receptacle portion of the cartridge before reassembly, without need for further specialized tools or equipment.

U.S. Pat. No. 5,400,573 issued to Richard G. Crystal et al. on Mar. 28, 1995 describes a Kit And Method For Opening, Refilling, And Sealing A Cartridge. The device is directed to use with a liquid ink reservoir, rather than with a toner cartridge, and includes a plunger which serves to drive a seal into the empty cartridge to open the cartridge for refilling, and then to drive a new seal into the opening to reseal the cartridge. The device does not provide any means to split the cartridge open, nor is it operable with a powdered toner cartridge, as in the present toner cartridge splitter.

Finally, U.S. Pat. No. 5,407,518 issued to Raymond Baley, Jr. on Apr. 18, 1995 describes a Device For Separating A Toner Cartridge, comprising a table saw having a single horizontally disposed blade, or a pair of oppositely disposed horizontal blades. The device is closely related to that disclosed in the '068 patent to Baley discussed further above, but goes on to provide a dual bladed saw, as noted. While the dual blade saw serves to simplify the cutting operation due to both sides of the cartridge being cut simultaneously, the device is relatively complex in comparison to the manual cartridge splitter of the present invention, which accomplishes the same function in a single manual operation.

None of the above noted patents, taken either singly or in combination, are seen to disclose the specific arrangement of concepts disclosed by the present invention.

SUMMARY OF THE INVENTION

By the present invention, an improved toner cartridge splitter is disclosed.

Accordingly, one of the objects of the present invention is to provide an improved toner cartridge splitter which is particularly adapted for use in the opening of toner cartridges for use with HP Laserjet (™) printers, but which may also be adapted for use with other types of powdered toner cartridges used with various xerographic printers and photocopiers.

Another of the objects of the present invention is to provide an improved toner cartridge splitter which provides means for affixing a toner cartridge immovably therein and aligned with the cutting edge of a splitter blade, and a splitter blade mounted in a channel to reciprocate therein and to drive the blade into the toner cartridge to split apart the two major components thereof for refilling and reuse.

Yet another of the objects of the present invention is to provide an improved toner cartridge splitter which includes means providing clearance for any stops or protrusions which may be built into a cartridge to preclude the driving of a device between the major components thereof.

Still another of the objects of the present invention is to provide an improved toner cartridge splitter which may be manually operated by means of a handle affixed directly to the movable blade portion, or which may alternatively be operated by means of an offset handle providing mechanical advantage to drive the blade portion of the device.

A final object of the present invention is to provide an improved toner cartridge splitter for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
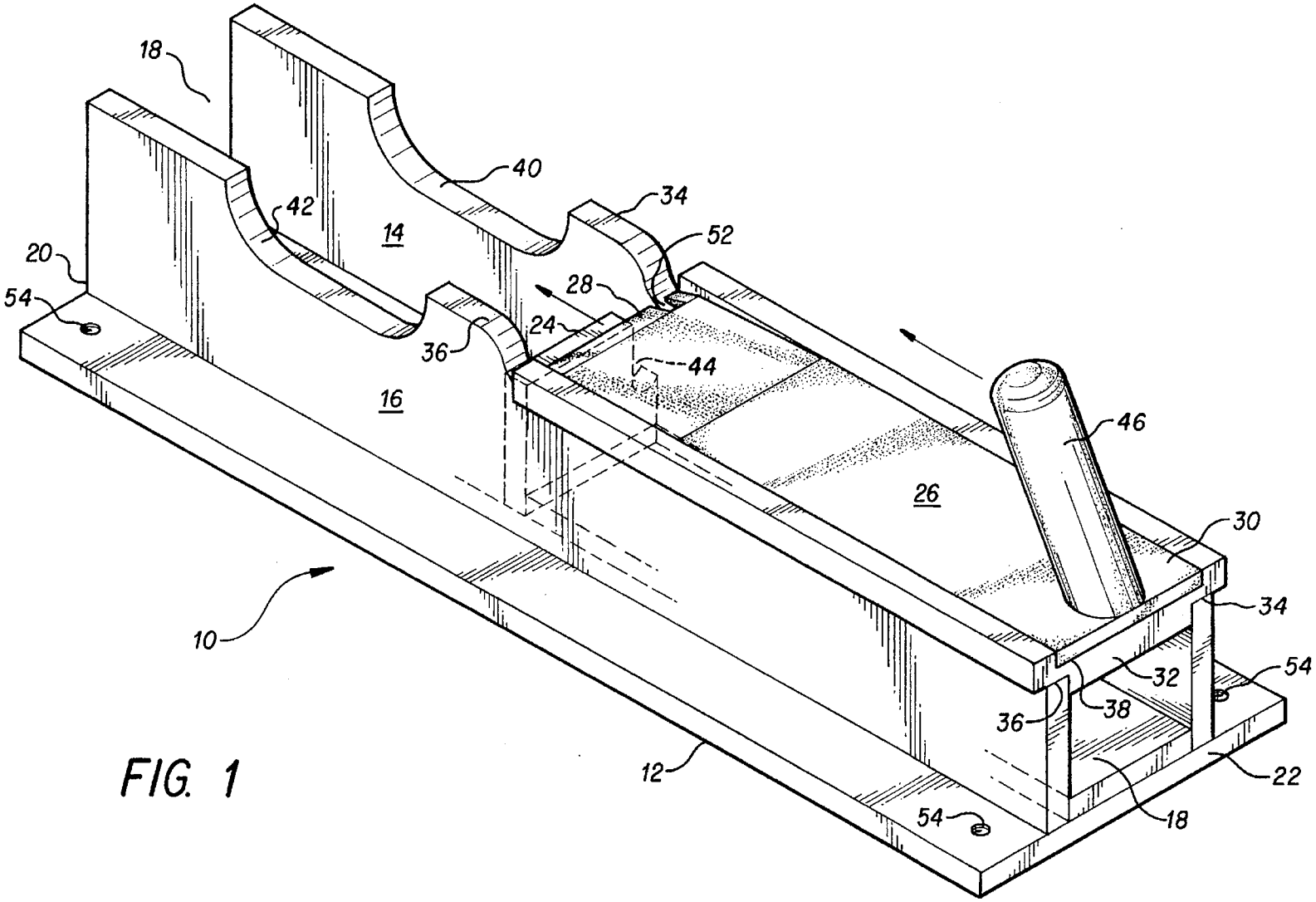
FIG. 1 is a perspective view of the present toner cartridge splitter, showing its various components and operation.

Referring now particularly to FIG. 1 of the drawings, the present invention will be seen to relate to a toner cartridge splitter 10, which is particularly adapted to split apart the two case halves comprising the primary components of a xerographic toner cartridge C (shown in FIG. 2) as used in HP Laserjet (™) printers. Obviously, the present invention may be adapted for use in splitting open toner cartridges having other configurations, as well, with modifications to the present splitter as required.

Figure 4:
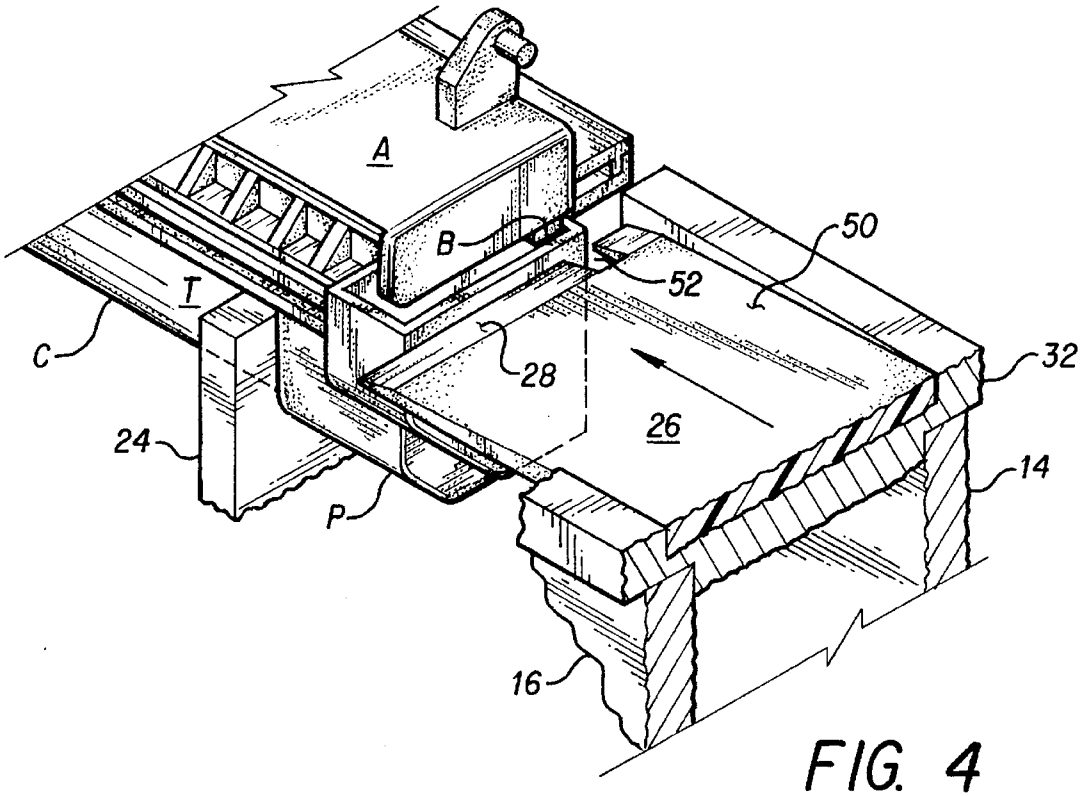
FIG. 4 is a perspective view in section of the central portion of the present invention, showing details of the clearance means for the blocking means which may be installed on certain toner cartridges.

The splitter 10 includes a flat, planar base plate 12, with a first and a second wall, respectively 14 and 16, extending upwardly therefrom and perpendicular thereto. The two walls 14 and 16 are parallel to one another and spaced apart from one another to define a channel 18 therebetween. The channel 18 (and walls 14 and 16 and base portion 12 defining the channel 18) has a toner cartridge holder end portion 20, and an opposite blade holder end portion 22. The channel 18 is dimensioned specifically to hold a toner cartridge C immovably therein, with the interior dimensions of the channel 18 closely fitting the lateral dimensions of the cartridge C to preclude lateral movement thereof when placed within the channel 18. This particular aspect of the present cartridge splitter 10, and a cartridge C placed therein, is shown in FIG. 4 of the drawings.

The cartridge C is also precluded from axial movement within the channel 18, by means of a transverse plate 24 which engages one end of a toner cartridge C placed within the cartridge holder end 20 of the channel 18. One end of the cartridge C fits over the plate 24, to preclude axial movement of the cartridge C within the channel 18. This arrangement is discussed more fully further below.

The blade holder end 22 of the channel 18 includes a flat, planar cartridge half separating or splitting blade 26 slidably disposed therein. The blade 26 includes a sharpened working end 28 and an opposite handle end 30, and is free to move axially and slidably within the upper portion of the channel 18. The blade 26 is positioned within the channel 18 so as to position the working end 28 to lie coplanar with the major seam of a toner cartridge C placed within the present splitter 10, as discussed in detail further below.

The blade 26 may be slidably positioned within the splitter 10 in a number of ways. The means indicated in the drawing figures of the present disclosure comprises a blade guide 32, which extends across the upper edges 34 and 36 of the first and second walls 14 and 16. The guide 32 includes a relatively wide and flat blade channel 38 therein, in which the blade 26 slides axially.

Figure 2:
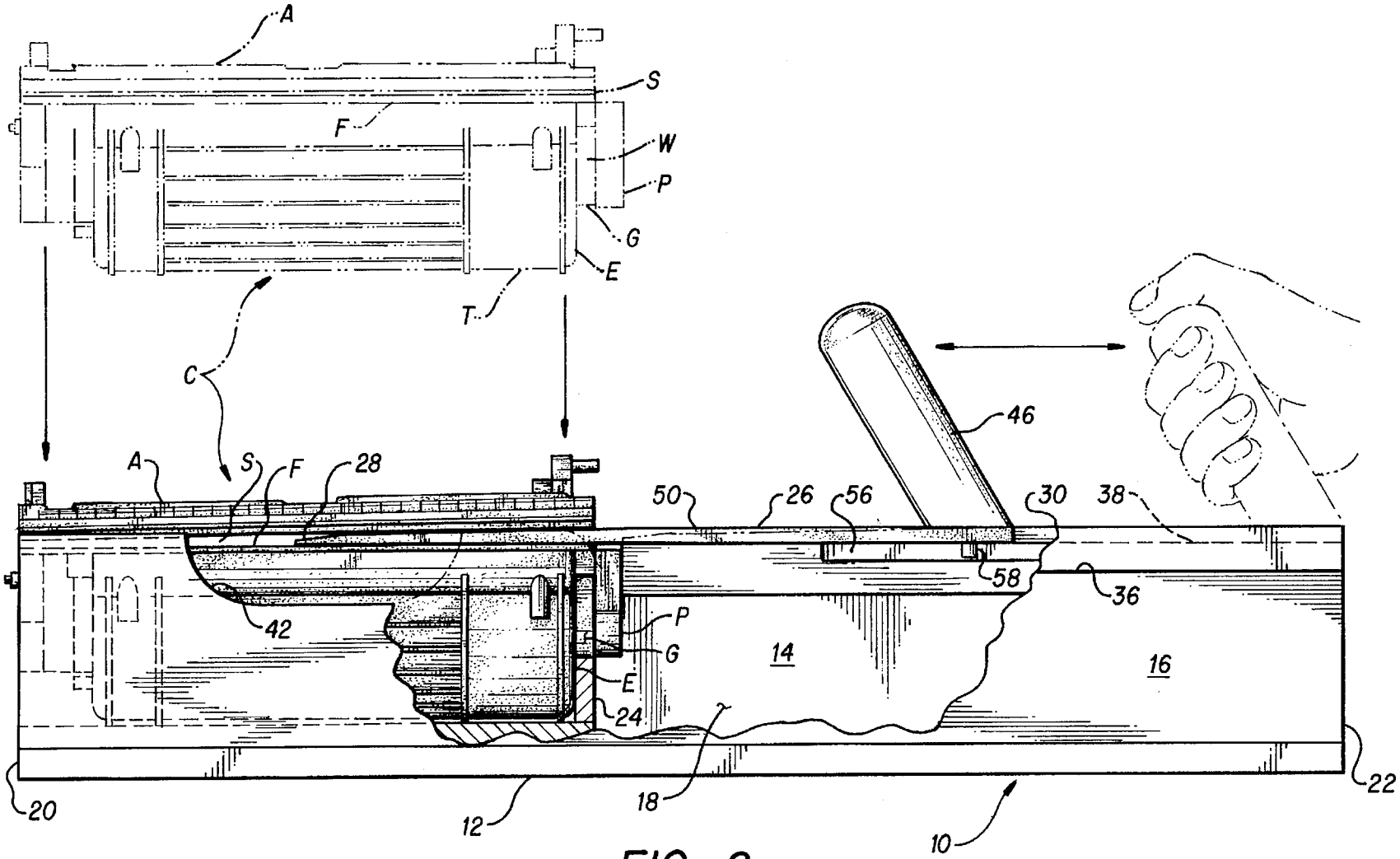
FIG. 2 is a side elevation view in partial section of the present invention, showing the installation of a toner cartridge therein and operation of the device.

FIG. 2 provides a detailed side elevation view in partial section, of the operation of the present invention. A toner cartridge C having a toner hopper or reservoir portion T and an attachment and component portion A joined at a flange F having a flat, planar seam S therebetween, is placed into the toner cartridge portion 20 of the channel 18. The flange F rests upon the upper edges 34 and 36 of the two walls 14 and 16, thereby positioning the cartridge seam S at the proper height to lie coplanar with the working end 28 of the blade 26. (The upper edges 34 and 36 of the two walls 14 and 16 may include reliefs 40 and 42 formed therein, to assist the user of the splitter 10 in the placement and removal of a cartridge C within and from the channel 18.)

Such toner cartridges C include opposite end plates P spaced apart from each end E of the toner hopper or reservoir by a gap G, and providing location for the cartridge C when it is installed in a printer or other xerographic device. This gap G is placed over the transverse plate 24, thereby precluding axial movement of the cartridge C within the splitter 10. Some cartridges C may have a web W between the end E and the end plate P. The present invention provides clearance for such a web W by means of a clearance slot 44 formed in the transverse plate 24 and adjacent the first wall 14 of the splitter 10. Thus, when a cartridge C is dropped into the toner cartridge holder end portion 20 of the splitter 10, the transverse plate 24 fits between the toner reservoir end E and the end plate P of the cartridge C, with the web W of the cartridge C dropping into the web clearance slot 44 to secure the cartridge C positively but removably within the splitter 10.

Figure 3:
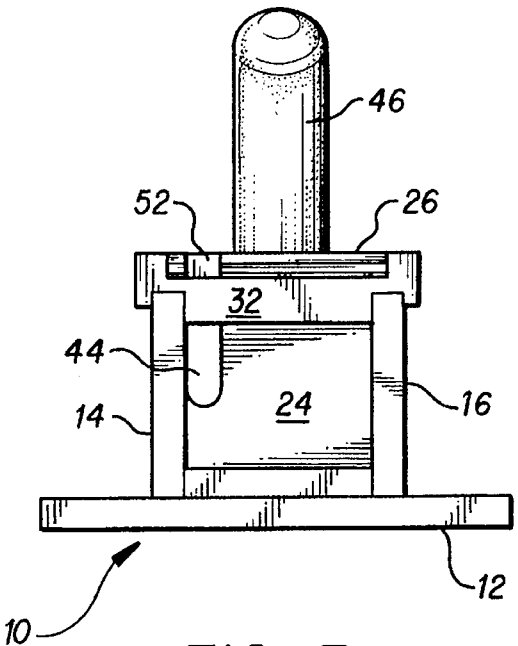
FIG. 3 is an end elevation view of the cartridge installation end of the present device, showing further details.

At this point, a user of the present splitter 10 grasps the handle (i.e., the cylindrical handle 46 of FIGS. 1 through 3, or the alternative handle of FIG. 5, discussed further below) and slides the blade 26 forward to drive the working edge 28 into the seam S of the cartridge C. (The handle 46 may be inclined with its upper end toward the working end 28 of the blade 26, for ergometric comfort.) The sharpened working edge 28 of the blade 26 comprises a wedge shape, tapered from the lower surface 48 of the blade, upwardly and rearwardly toward the parallel upper surface 50 of the blade 26. This wedge shape serves to lift the upper portion A of the cartridge C from the lower portion T, splitting the portions apart along the seam S, as shown in FIG. 2.

Many of the cartridges C for which the present splitter 10 is adapted, include a separation stop or block B, extending from the flange F to block a blade or other article which may be inserted into the seam S of the cartridge C; this block B is more clearly shown in FIG. 4. The purpose of this separation stop B is to discourage the separation of the two major cartridge components T and A, by means of relatively simple blades or knives inserted into the seam S. The present blade 26 may include a clearance notch 52 therein, which notch 52 is aligned with the stop B. Thus, when the blade 26 is advanced to split the cartridge case components T and A, the blade notch 52 provides clearance around the block B until the working edge 28 of the blade 26 is wedged between the two cartridge components T and A and has started to separate them along the seam S. Once the upper or attachment component A has been is lifted somewhat by the inclined surface of the working edge 28 of the blade 26, the remainder of the blade can slide beneath the uplifted stop or block B to advance between the cartridge case components T and A, to split the cartridge C open for refilling, installation of a fresh seal, and reassembly of the two cartridge case components.

It will be apparent that some degree of force may be required to force the blade 26 between the two cartridge components T and A. Accordingly, means are provided to secure the present splitter 10 to a table, work bench, or other underlying surface. A plurality of fastener holes 54 may be provided through the base plate 12, in order that the present splitter 10, in any of its embodiments, may be secured solidly to an underlying surface as desired or required.

As some degree of force will generally be required for the operation of the blade 26, it is desirable to provide some form of stop means for the blade to preclude excessive travel through the cartridge holder portion 20 of the splitter 10. Accordingly, the blade guide 32 may be provided with a slot 56 formed therein, with a pin 58 extending from beneath the blade 26 to engage the slot 56. (The pin 58 may be provided at any corresponding location below the blade 26, according to the positioning of the slot 56 in the guide 32, but may comprise a protruding attachment means for the handle 46, if desired.) The pin 58 is precluded from travel beyond the slot 56 end closest to the cartridge holder end portion 20 of the splitter, thus stopping travel of the blade 26 at that point.

Figure 5:
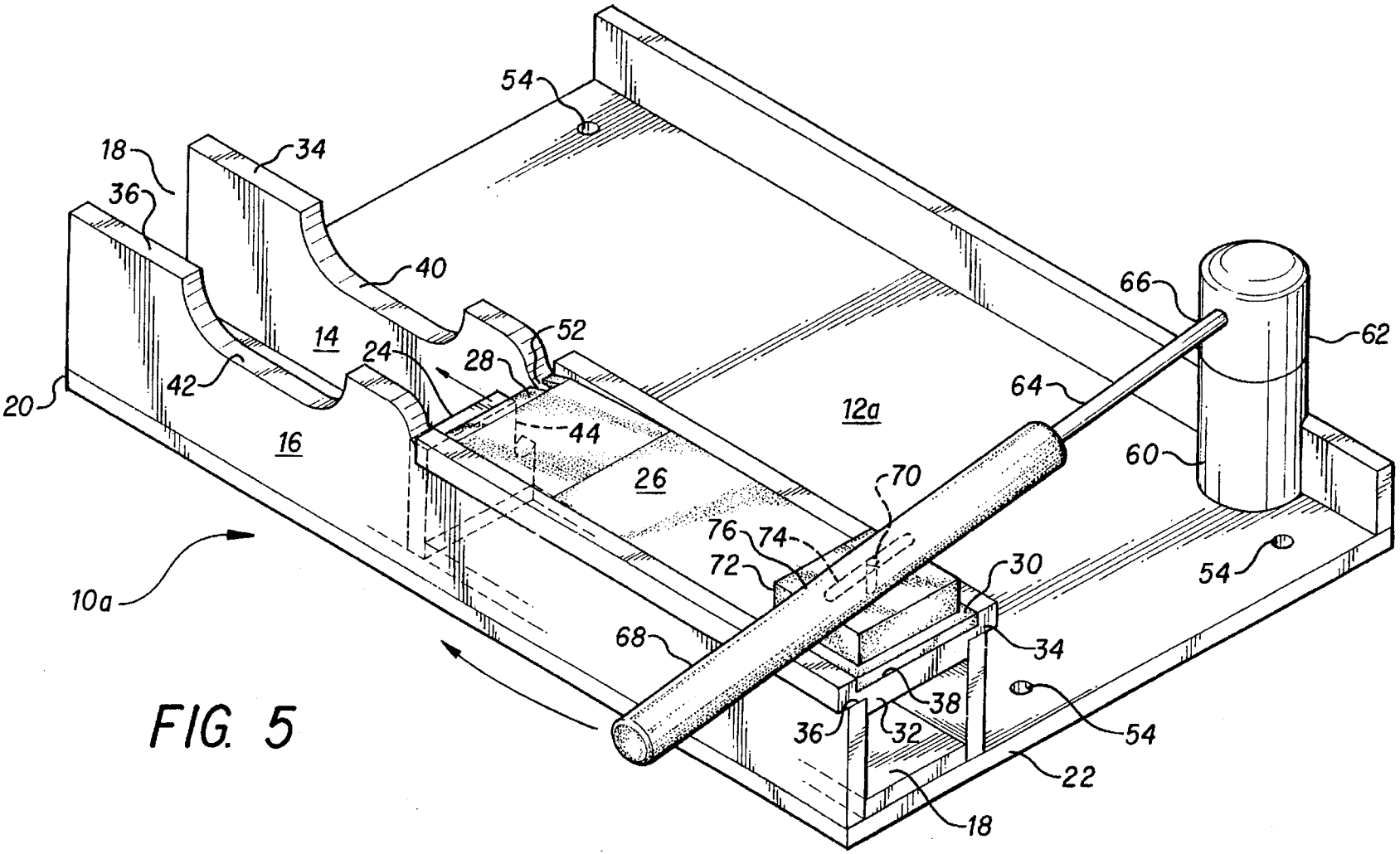
FIG. 5 is a perspective view of an alternate embodiment of the present toner cartridge splitter, disclosing a different handle arrangement providing additional leverage to the user thereof.

In order to provide the leverage which may be required for the splitting force necessary to separate the two sealed cartridge components T and A, an alternative handle means may be provided as shown in the splitter 10*a* of FIG. 5. The splitter 10*a* of FIG. 5 will be seen to have components identical to those described above in FIGS. 1 through 4, with the exception of the wider base plate 12*a* and the handle means. The splitter 10*a* of FIG. 5 includes an offset handle, comprising a fixed handle pivot base 60 disposed to one side of the channel 18. A rotary handle pivot 62 is installed thereon, with an elongate handle 64 extending therefrom. The handle 64 is connected to the handle pivot at a pivot attachment end 66, with an opposite hand grip end 68 extending therefrom. The blade 26 includes a handle engagement pin 70 extending upwardly therefrom (or from a block 72 mounted thereon), which pin 70 engages a blade pin attachment slot 74 formed in the underside of the intermediate portion 76 of the handle 64.

The user of the toner cartridge splitter of FIG. 5 may place a cartridge C within the splitter channel 18, as described above, and draw the hand grip end 68 of the handle 64 toward the cartridge holder end 20 of the splitter 10*a*. As the handle 64 travels arcuately about the handle pivot 62 and the blade 26 travels linearly within the blade guide 32, the handle slot 74 provides for the difference in relative motions between handle 64 and blade 26 as the handle engagement pin 70 rides within the slot 74.

As the hand grip end 68 of the handle 64 extends substantially beyond the handle engagement pin 70, a corresponding mechanical advantage will be provided for the user at the expense of additional travel for the hand grip end 68 of the handle 64 relative to the travel of the blade 26. For example, if the hand grip end 68 of the handle 64 is twice the distance from the handle pivot 62 as the handle engagement pin 70, the force developed at the handle engagement pin 70 to drive the blade 26 into the seam S of a toner cartridge C will be twice that applied at the hand grip end 68 of the handle 64, to provide further ease of operation of the splitter 10*a*.

In summary, the present toner cartridge splitters 10 and 10*a* will be seen to provide a substantial cost savings to a user of toner cartridges C used in various xerographic machines. Rather than turning a perfectly usable cartridge C back to the manufacturer or to another source for refilling with toner, a user of the present cartridge splitter 10 and 10*a* need only drop the cartridge C into the splitter and separate the two major components of the cartridge. Fresh toner may then be added, a fresh seal applied between the cartridge components, and the components resealed together, to provide a replenished cartridge essentially as good as new.

It is to be understood that the present invention is not limited to the sole embodiments described above, but encompasses any and all embodiments within the scope of the following claims.

I claim:

1. A toner cartridge splitter adapted for the opening of toner cartridges having two case halves joined by a flat, planar seam therebetween as used in xerographic photocopying and printing, said splitter comprising:

a flat, planar base having a first and a parallel opposite second wall extending upwardly therefrom and normal thereto to define a channel including a cartridge holder portion and an opposite blade holder portion;

each said wall of said cartridge holder portion including an upper edge having a cartridge gripping relief formed therein; and a plate fixedly connected to said first wall and said second wall and extending upward from said base between said cartridge holder portion and said blade holder portion for precluding axial movement of the toner cartridge;

said blade holder portion including a flat, planar blade slidingly and axially movable therein, said blade having a tapered and sharpened working end disposed toward said cartridge holder portion, and a handle affixed thereto and extending upwardly therefrom, whereby;

the toner cartridge is placed within said cartridge holder portion with a cartridge seam disposed coplanar with said blade, and said blade is driven into the cartridge seam to separate toner cartridge case halves from one another.

2. The toner cartridge splitter of claim 1, wherein:

each said wall of said blade holder portion includes an upper edge, with a blade guide being affixed between each said upper edge;

said blade guide including a wide, shallow blade guide channel formed centrally therein, with said blade guide channel precluding lateral movement of said blade axially and slidably installed therein.

3. The toner cartridge splitter of claim 1, wherein:

said working end includes at least one clearance notch therein, said at least one clearance notch being adapted to provide clearance for any case half separation stops formed in the toner cartridge.

4. The toner cartridge splitter of claim 1, wherein:

said blade includes a flat, planar upper surface and a flat, planar lower surface parallel thereto, with said lower surface of said blade being disposed coplanar with the case half seam of the toner cartridge and said working edge of said blade comprising a wedge shaped ramp sloping upwardly from said lower surface of said blade to said upper surface of said blade and toward said opposite end of said blade, with said upwardly sloping ramp being adapted to drive between the case halves of the toner cartridge and lift one case half from the other case half to separate the two.

5. The toner cartridge splitter of claim 1, wherein:

said plate includes a clearance slot formed therein and disposed adjacent said first wall, said clearance slot being adapted to provide clearance for a web extending between an end plate and a filler cap end of the toner cartridge.

6. The toner cartridge splitter of claim 1, wherein:

said handle comprises a cylindrical rod inclined toward said plate.

7. The toner cartridge splitter of claim 1, wherein:

said base includes means for attaching the toner cartridge splitter to an underlying surface.

8. The toner cartridge splitter of claim 7, wherein:

said underlying surface attachment means comprises a plurality of mounting holes formed through said base.

9. A toner cartridge splitter adapted for the opening of toner cartridges having two case halves joined by a flat, planar seam therebetween as used in xerographic photocopying and printing, said splitter comprising:

a flat, planar base having a first and a parallel opposite second wall extending upwardly therefrom and normal thereto to define a channel including a cartridge holder portion and an opposite blade holder portion;

each said wall of said cartridge holder portion including an upper edge having a cartridge gripping relief formed therein; and a plate fixedly connected to said first wall and said second wall and extending upward from said base between said cartridge holder portion and said blade holder portion for precluding axial movement of the toner cartridge;

said blade holder portion including a flat, planar blade slidingly and axially movable therein, said blade having a tapered and sharpened working end disposed toward said cartridge holder portion, and an offset handle pivotally and removably affixed thereto, whereby;

the toner cartridge is placed within said cartridge holder portion with a cartridge seam disposed coplanar with said blade, and said blade is driven into the cartridge seam to separate toner cartridge case halves from one another.

10. The toner cartridge splitter of claim 9, wherein:

each said wall of said blade holder portion includes an upper edge, with a blade guide being affixed between each said upper edge;

said blade guide including a wide, shallow blade guide channel formed centrally therein, with said blade guide channel precluding lateral movement of said blade axially and slidably installed therein.

11. The toner cartridge splitter of claim 9, wherein:

said working end includes at least one clearance notch therein, said at least one clearance notch being adapted to provide clearance for any case half separation stops formed in the toner cartridge.

12. The toner cartridge splitter of claim 9, wherein:

said blade includes a flat, planar upper surface and a flat, planar lower surface parallel thereto, with said lower surface of said blade being disposed coplanar with the case half seam of the toner cartridge and said working edge of said blade comprising a wedge shaped ramp sloping upwardly from said lower surface of said blade to said upper surface of said blade and toward said opposite end of said blade, with said upwardly sloping ramp being adapted to drive between the case halves of the toner cartridge and lift one case half from the other case half to separate the two.

13. The toner cartridge splitter of claim 9, wherein:

said plate includes a clearance slot formed therein and disposed adjacent said first wall, said clearance slot being adapted to provide clearance for a web extending between an end plate and a filler cap end of the toner cartridge.

14. The toner cartridge splitter of claim 9, wherein:

said handle comprises an offset handle pivot extending upwardly from said base with an elongate handle extending therefrom, with said handle having a pivot attachment end, an opposite hand grip end, and an intermediate blade pin attachment slot extending over and across said blade;

said blade including a handle engagement pin adapted to removably engage said blade pin attachment slot, said hand grip end providing a mechanical advantage for an operator of the toner cartridge splitter.

15. The toner cartridge splitter of claim 9, wherein:

said base includes means for attaching the toner cartridge splitter to an underlying surface.

16. The toner cartridge splitter of claim 15 wherein:

said underlying surface attachment means comprises a plurality of mounting holes formed through said base.

17. A toner cartridge splitter adapted for the opening of toner cartridges having two case halves joined by a flat, planar seam therebetween as used in xerographic photocopying and printing processes, said splitter comprising:

a flat, planar base having a first and a parallel opposite second wall extending upwardly therefrom and normal thereto to define a channel therebetween, said channel being adapted to preclude lateral movement of a toner cartridge placed therein;

a blade holder portion adapted to move axially and slidably about an upper portion of said channel, said blade holder portion having a working end and an opposite handle end, said working end having a blade disposed proximate said upper portion, said handle end having a handle affixed thereto and extending upwardly therefrom, said blade being notched for providing clearance of a case half separation stop formed in the toner cartridge, whereby;

the toner cartridge is placed within said channel with a cartridge seam disposed coplanar with said blade, and said blade is driven into the toner cartridge to separate the toner cartridge case halves from one another.

* * * * *